United States Patent [19]

Glaesel

[11] 3,999,829

[45] Dec. 28, 1976

[54] SCREWLESS ELECTRICAL TERMINAL

[75] Inventor: Gottfried Glaesel, Ascona, Switzerland

[73] Assignee: Hego Electric G.m.b.H., Glarus, Switzerland

[22] Filed: June 25, 1975

[21] Appl. No.: 590,161

[30] Foreign Application Priority Data

Jan. 7, 1975 United Kingdom ..... 688/75

[52] U.S. Cl. ..... 339/95 D; 339/274

[51] Int. Cl.[2] ..... H01R 9/12

[58] Field of Search ..... 339/95, 274, 255, 260, 339/261

[56] References Cited

UNITED STATES PATENTS

| | | | |
|---|---|---|---|
| 1,411,263 | 4/1922 | Bellis | 339/274 |
| 3,579,283 | 5/1971 | Welburn | 339/274 |
| 3,867,004 | 2/1975 | Komorowski et al. | 339/95 D |

FOREIGN PATENTS OR APPLICATIONS

| | | | |
|---|---|---|---|
| 201,227 | 2/1956 | Australia | 339/95 D |
| 19,500 | 9/1898 | United Kingdom | 339/274 |

*Primary Examiner*—Joseph H. McGlynn
*Attorney, Agent, or Firm*—Pollock, Vande Sande & Priddy

[57] ABSTRACT

An electrical terminal comprising a rigid bent sheet metal member having a first portion provided with a projecting pivot and a second portion spaced from and generally parallel to the pivot, a cam pivotable on the pivot and having an eccentric surface facing the said second portion, and a torsion spring acting on the cam to urge the eccentric surface towards the said second portion for clamping a conductor inserted therebetween. Preferably the member is of channel section, its web forming the second portion and a flange forming the first portion. The torsion spring preferably has a helical portion which is fitted over the pivot and on which the cam is fitted, and a leg acting on the cam.

10 Claims, 7 Drawing Figures

SCREWLESS ELECTRICAL TERMINAL

This invention relates to electrical terminals in which contact pressure for clamping a conductor is provided not by a clamping screw but by a spring.

Screwless terminals are known, in which the pressure of a spring is applied to the conductor directly or through an intermediate member, but existing terminals are unreliable, or else complex and expensive.

The present invention resides in an electrical terminal comprising a rigid bent sheet metal member having a first portion provided with a projecting pivot and a second portion spaced from and generally parallel to the pivot, a cam pivotable on the pivot and having an eccentric surface facing the said second portion, and a torsion spring acting on the cam to urge the eccentric surface towards the said second portion for clamping a conductor inserted therebetween.

Such an arrangement can provide reliable clamping but nevertheless employs only a small number of simple parts.

Preferably, the said sheet metal member is of channel section, with the web of the channel forming the said second portion and a flange of the channel forming the said first portion, and the cam extending between the two flanges of the channel. With such an arrangement, the conductor is very reliably located.

Preferably, the torsion spring is mounted on the sheet metal member, so that the entire terminal is self-contained and can be mounted without modification in a wide variety of situations, e.g., in different types of insulating housing and in combination with numerous different types of further terminal for connection of a second conductor. For connection of a second conductor, numerous arrangements are possible. For example, the sheet metal member may be formed with two of the said second portions associated with respective cams, i.e., with two substantially identical terminals integral with one another. Alternatively, a conductive member may have a portion thereof inserted between the said second portion of the sheet metal member and the cam, for connecting an inserted conductor to a further terminal. This arrangement has the advantage that only the conductive member need be of high conductivity, since it is clamped in direct contact with the inserted conductor. The said conductive member may lead to a further substantially identical terminal, or to some other kind of terminal, e.g., a solder tag, a wound-wire terminal, or a plug-in terminal. Alternatively, the bent sheet metal member may have an integral portion thereof adapted to form a solder tag, wound-wire terminal, plug-in terminal or other form of terminal.

In a particularly preferred arrangement, the torsion spring has a helical spring fitted over the pivot, the cam has a bearing aperture fitted over the helical portion, and the spring has a projecting leg which acts on the cam.

The invention will be further described with reference to the accompanying drawings, which illustrate embodiments thereof, and in which.

Figure 1:
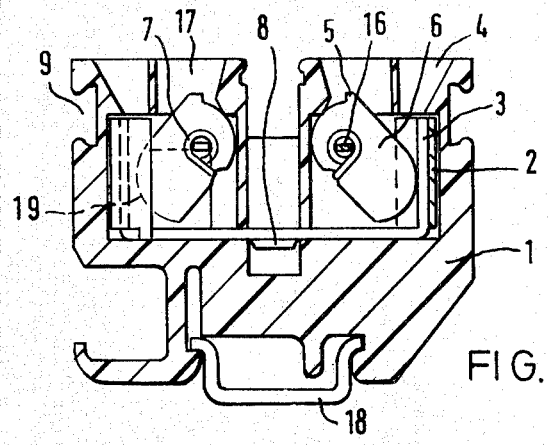
FIG. 1 shows a terminal block incorporating two terminals according to the invention.

FIG. 1 shows a terminal block with an insulating housing 1 having a foot portion for engaging a symmetrical flanged channel-section supporting bar 18 so that a plurality of such terminal blocks can be mounted side by side. The housing has apertures 4 for the insertion of stripped wires and contains two terminals with an interconnecting bar 3 of highly conductive metal, provided with a socket 8 for making cross connections to other terminal blocks. The housing also has recesses 9 for labels.

Figure 2:
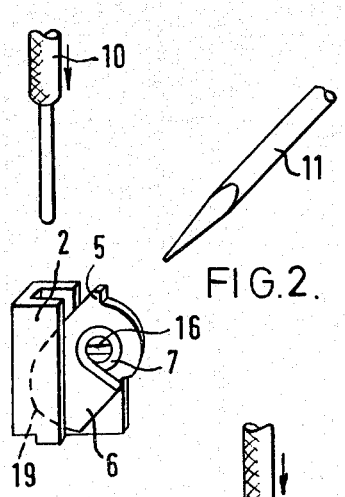
FIG. 2 shows one of the terminals.
Figure 3:
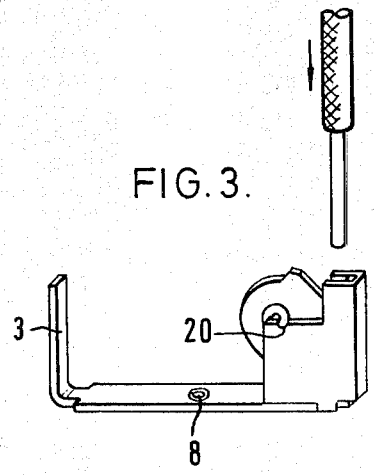
FIG. 3 shows one terminal seen from the opposite side.

Each terminal, as can be seen more clearly in FIGS. 2 and 3, includes a sheet metal member 2 bent to form a channel, one flange of this channel being wider than the other and having an integral pivot 16 projecting at right angles thereto on the same side as and parallel to the web of the channel. A torsion spring 7 has a helical portion which is fitted over the pivot 16. A cam 6 of sheet metal has a bearing aperture fitted over the helical portion of the spring so that the cam can pivot. The cam has an eccentric curved surface 19 facing the web portion of the channel, and the spring has a leg which engages a notch in an edge of the cam, so that the spring urges the eccentric surface 19 towards the web of the channel. It is not necessary that the cam should actually come into contact with the web of the channel, provided that any gap remaining adjacent to the surface 19 is smaller than the smallest wire to be inserted.

As can be seen in FIG. 3, the other end 20 of the spring engages the flange of the member 2 adjacent to the pivot 16, to fix this end of the spring against movement when the cam is moved away from the web of the channel.

As can be seen in FIG. 2, a stripped wire conductor 10 is inserted longitudinally into the channel so as to push the cam away from the web of the channel, thereby stressing the spring 7 so that the wire will be clamped by the surface 19 of the cam. This surface of the cam is so positioned as to resist withdrawal of the wire, and in addition may be grooved, toothed, or otherwise roughened to improve its grip on the wire. To enable the cam to be forcibly pivoted away from the web of the channel, to permit removal of the wire and if necessary to facilitate insertion of the latter, one edge of the cam has a notch, or a lug 5 as shown, which can be engaged by a thin tool such as a screwdriver 11 to pivot the cam. For this purpose, apertures 17 are provided in the insulating housing. Alternatively, the cam may have a projecting lever which can be manually operated to pivot the cam.

In the arrangement shown in FIGS. 1 and 3, the bar 3 is U-shaped, with a limb at each end which is inserted between the associated cam and channel so that the inserted wire 10 is clamped against the limbs of the bar 3, not directly against the channel. With this arrangement, only the bar 3 need be of high conductivity, since the cam and channel serve only to generate the contact pressure.

The two terminals can be identical, with one turned through 180° relative to the other, or they can be mirror images of one another.

Figure 4:
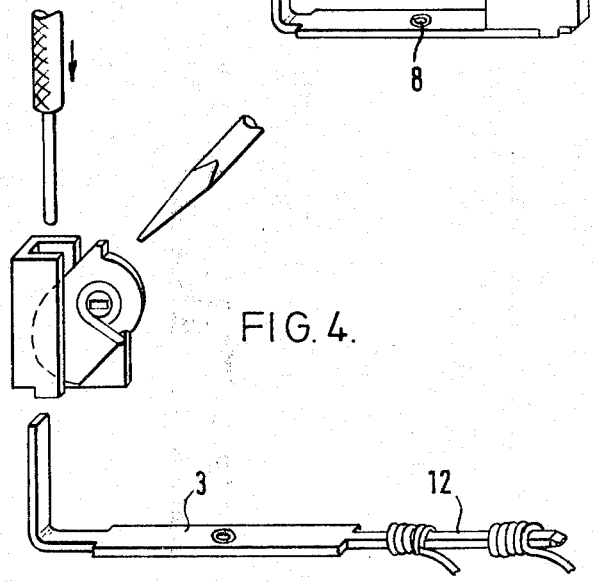
FIGS. 4 to 6 show terminals embodying the invention in combination with other forms of terminal.

FIG. 4 shows an alternative arrangement in which one end of the bar 3 is bent to form a limb fitting into a channel of a terminal as shown in FIG. 1, whereas the other end of the bar 3 forms a pin 12 for a wound-wire connection.

Figure 5:
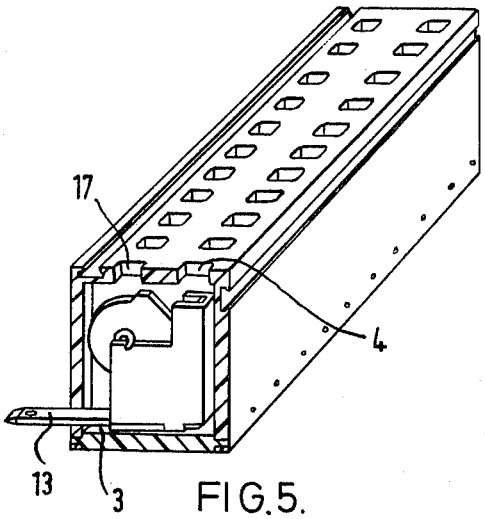

FIG. 5 shows a multi-pole terminal block containing a plurality of terminals as shown in FIG. 1, but in this case one end of the bar 3 forms a solder tag 13.

Figure 6:
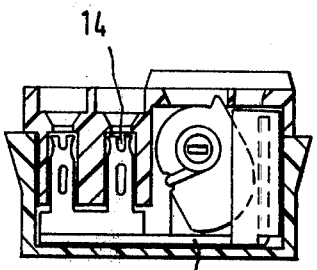

FIG. 6 shows a further arrangement in which a terminal of the kind shown in FIG. 1 is combined with a bar 3 connecting it to plug sockets 14, in a modular insulating housing.

Figure 7:
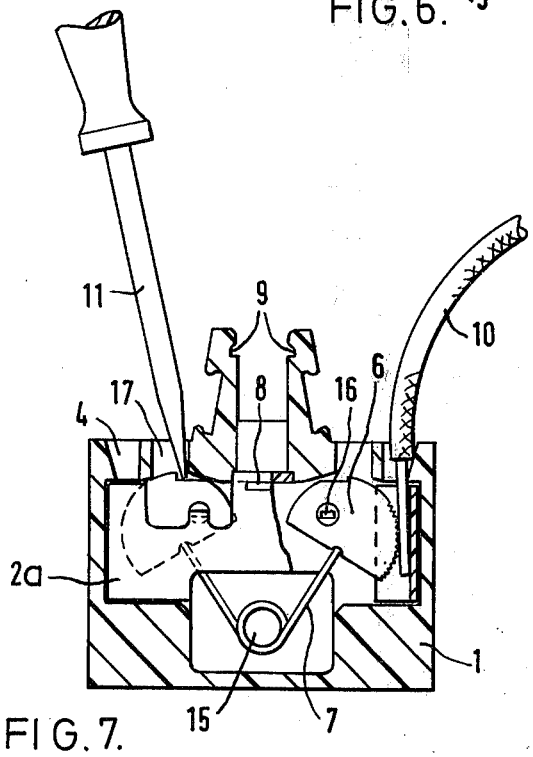
FIG. 7 shows a further terminal embodying the invention.

FIG. 7 shows a different embodiment of the invention, in which the connecting bar 3 is omitted and instead two integral terminals are provided. That is to say, a single sheet metal part 2A is bent at opposite sides to form a pair of spaced channels, and the intermediate region of the part 2A is provided with pivots 16 each carrying a respective cam 6, one for each channel. In this case, the metal member 2A must be of high conductivity, at least where it makes contact with the inserted wire. An upper part of the member 2A is bent over and pierced to form a cross-connection socket 8. In this embodiment, the spring 7 has two projecting legs each engaging a respective cam, and the helical portion of the spring is mounted on a pin 15 of the insulating housing 1.

I claim:

1. An electrical terminal comprising a rigid bent sheet metal member having a first portion provided with a projecting pivot and a second portion spaced from and generally parallel to the pivot, a cam pivotable on the pivot and having an eccentric surface facing the said second portion, and a torsion spring action on the cam to urge the eccentric surface towards the said second portion for clamping, in use, a conductor inserted therebetween, and in which the torsion spring has a helical portion fitted over the pivot, the cam has a bearing aperture fitted over the said helical portion, and the spring has a projecting leg acting on the cam.

2. A terminal as claimed in claim 1, wherein the said member is of channel section, the web of the channel forming the said second portion and a flange of the channel forming the said first portion.

3. A terminal as claimed in claim 1, in which the said surface is roughened.

4. A terminal as claimed in claim 1 in which the cam has a projecting lever whereby the cam can be manually pivoted away from the said second portion.

5. A terminal as claimed in claim 1 in which the cam has means for engagement by a tool to pivot the cam away from the said second portion.

6. A terminal as claimed in claim 1 in which the sheet metal member comprises two said second portions and respective cams.

7. A terminal as claimed in claim 1, in which the pivot is a bent-over integral portion of the said first portion of the sheet metal member.

8. A terminal as claimed in claim 1, comprising a conductive member which has a portion thereof inserted between the said second portion and the cam and is arranged to connect a said conductor to a further terminal.

9. A terminal as claimed in claim 8, in which the further terminal is substantially identical to the first terminal.

10. A terminal as claimed in claim 9, in which the conductive member is a U-shaped metal bar whose limbs form the said portions thereof.

* * * * *